US008419356B2

(12) United States Patent
Little

(10) Patent No.: US 8,419,356 B2
(45) Date of Patent: Apr. 16, 2013

(54) TURBINE SEAL ASSEMBLY

(75) Inventor: David A. Little, Chuluota, FL (US)

(73) Assignee: Siemens Energy, Inc., Orlando, FL (US)

( * ) Notice: Subject to any disclaimer, the term of this patent is extended or adjusted under 35 U.S.C. 154(b) by 943 days.

(21) Appl. No.: 12/416,423

(22) Filed: Apr. 1, 2009

(65) Prior Publication Data

US 2010/0074734 A1 Mar. 25, 2010

Related U.S. Application Data

(60) Provisional application No. 61/100,033, filed on Sep. 25, 2008.

(51) Int. Cl.
*F01D 25/24* (2006.01)

(52) U.S. Cl.
USPC ..... 415/173.1; 415/230; 415/173.7

(58) Field of Classification Search ..... 415/191, 415/174.5, 173.4, 173.5, 116, 173.1, 173.7, 415/230; 277/418, 402, 403
See application file for complete search history.

(56) References Cited

U.S. PATENT DOCUMENTS

| | | | | |
|---|---|---|---|---|
| 3,647,311 | A | 3/1972 | Wootton et al. | |
| 4,425,079 | A | 1/1984 | Speak et al. | |
| 5,358,374 | A * | 10/1994 | Correia et al. | 415/47 |
| 5,503,528 | A | 4/1996 | Glezer et al. | |
| 5,967,745 | A | 10/1999 | Tomita et al. | |
| 6,152,690 | A | 11/2000 | Tomita et al. | |
| 6,189,891 | B1 | 2/2001 | Tomita et al. | |
| 6,217,279 | B1 | 4/2001 | Ai et al. | |
| 6,506,016 | B1 | 1/2003 | Wang | |
| 6,558,114 | B1 | 5/2003 | Tapley et al. | |
| 6,854,736 | B2 | 2/2005 | Paprotna | |
| 7,059,829 | B2 | 6/2006 | Garner | |
| 7,234,918 | B2 | 6/2007 | Brillert et al. | |
| 7,244,104 | B2 * | 7/2007 | Girgis et al. | 416/193 A |
| 2004/0265118 | A1 * | 12/2004 | Naik et al. | 415/116 |
| 2007/0059163 | A1 | 3/2007 | Tiemann | |
| 2008/0056889 | A1 * | 3/2008 | Cheng et al. | 415/174.4 |
| 2010/0119364 | A1 * | 5/2010 | Bunker | 415/199.5 |

OTHER PUBLICATIONS

U.S. Appl. No. 12/022,302, filed Jan. 30, 2008, Diakunchak.
U.S. Appl. No. 12/355,878, filed Jan. 19, 2009, Liang.

* cited by examiner

*Primary Examiner* — Caridad Everhart

(57) ABSTRACT

A seal assembly that limits gas leakage from a hot gas path to one or more disc cavities in a turbine engine. The seal assembly includes a seal apparatus that limits gas leakage from the hot gas path to a respective one of the disc cavities. The seal apparatus comprises a plurality of blade members rotatable with a blade structure. The blade members are associated with the blade structure and extend toward adjacent stationary components. Each blade member includes a leading edge and a trailing edge, the leading edge of each blade member being located circumferentially in front of the blade member's corresponding trailing edge in a direction of rotation of the turbine rotor. The blade members are arranged such that a space having a component in a circumferential direction is defined between adjacent circumferentially spaced blade members.

19 Claims, 4 Drawing Sheets

TURBINE SEAL ASSEMBLY

CROSS-REFERENCE TO RELATED APPLICATION

This application claims the benefit of U.S. Provisional Application Ser. No. 61/100,033, entitled RIM SEAL INCORPORATING BLADES, filed Sep. 25, 2008, the entire disclosure of which is incorporated by reference herein.

This invention was made with U.S. Government support under Contract Number DE-FC26-05NT42644 awarded by the U.S. Department of Energy. The U.S. Government has certain rights to this invention.

FIELD OF THE INVENTION

The present invention relates generally to a seal assembly for use in a turbine engine, and more particularly, to a seal assembly including a plurality of blade members that rotate with the rotor and limit leakage from a hot gas path to a disc cavity in the turbine engine.

BACKGROUND OF THE INVENTION

In multistage rotary machines used for energy conversion for example, a fluid is used to produce rotational motion. In a gas turbine engine, for example, a gas is compressed in a compressor and mixed with a fuel source in a combustor. The combination of gas and fuel is then ignited to create a combustion gas that defines a working gas that is directed to turbine stage(s) to produce rotational motion. Both the turbine stage(s) and the compressor have stationary or non-rotary components, such as vanes, for example, that cooperate with rotatable components, such as rotor blade structures, for example, for compressing and expanding the operational gases. Many components within the machines must be cooled by cooling air to prevent the components from overheating.

Leakage of a working gas from a hot gas path to a disc cavity in the machines reduces performance and efficiency. Working gas leakage into the disc cavities yields higher disc and blade root temperatures and may result in reduced performance and reduced service life and/or failure of the components in and around the disc cavities.

SUMMARY OF THE INVENTION

In accordance with a first aspect of the invention, a seal assembly is provided that limits gas leakage from a hot gas path to one or more disc cavities in a turbine engine comprising a plurality of stages, each stage comprising a plurality of stationary components and a disc structure supporting a plurality of blade structures for rotation on a turbine rotor. The seal assembly comprises a first seal apparatus that limits gas leakage from the hot gas path to a first disc cavity associated with a first axially facing side of a blade structure including a row of airfoils. The first seal apparatus comprises a plurality of first blade members rotatable with the blade structure. The first blade members are associated with the first axially facing side of the blade structure and extend toward adjacent first stationary components. Each first blade member includes a leading edge and a trailing edge. The leading edge of each first blade member is located circumferentially in front of the trailing edge of the corresponding first blade member in a direction of rotation of the turbine rotor. The first blade members are arranged such that a space having a component in a circumferential direction is defined between adjacent circumferentially spaced first blade members.

In accordance with a second aspect of the invention, a seal assembly is provided that limits gas leakage from a hot gas path to one or more disc cavities in a turbine engine comprising a plurality of stages, each stage comprising a plurality of stationary components and a disc structure supporting a plurality of blade structures for rotation on a turbine rotor. The seal assembly comprises a first seal apparatus that limits gas leakage from the hot gas path to a first disc cavity associated with a first axially facing side of a blade structure including a row of airfoils. The first seal apparatus comprises a first wing member and a plurality of first wing blade members. The first wing member extends axially from the first axially facing side of the blade structure toward an adjacent first annular inner shroud associated with adjacent first stationary components. The first wing member including a radially inner side and a radially outer side. The first wing blade members are rotatable with the blade structure and are arranged on the radially outer side of the first wing member such that a space having a component in a circumferential direction is defined between adjacent circumferentially spaced first wing blade members. Each of the first wing blade members extends radially outwardly from the outer side of the first wing member toward a radially facing surface of the first annular inner shroud. The radially facing surface of the first annular inner shroud at least partially axially overlaps the first wing blade members.

In accordance with a third aspect of the invention, a seal assembly is provided that limits gas leakage from a hot gas path to one or more disc cavities in a turbine engine comprising a plurality of stages, each stage comprising a plurality of stationary components and a disc structure supporting a plurality of blade structures for rotation on a turbine rotor. The seal assembly comprises a first seal apparatus that limits gas leakage from the hot gas path to a first disc cavity associated with a first axially facing side of a blade structure including a row of airfoils. The first seal apparatus comprises a plurality of first radial blade members. The first radial blade members extend axially outwardly from the first axially facing side of the blade structure toward an adjacent first annular inner shroud associated with adjacent first stationary components. The first radial blade members are arranged such that a space having a component in a circumferential direction is defined between adjacent circumferentially spaced first radial blade members. A radially inner corner portion of each first radial blade member is located proximate to a radially outwardly facing surface of an axial end portion of the first annular inner shroud.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
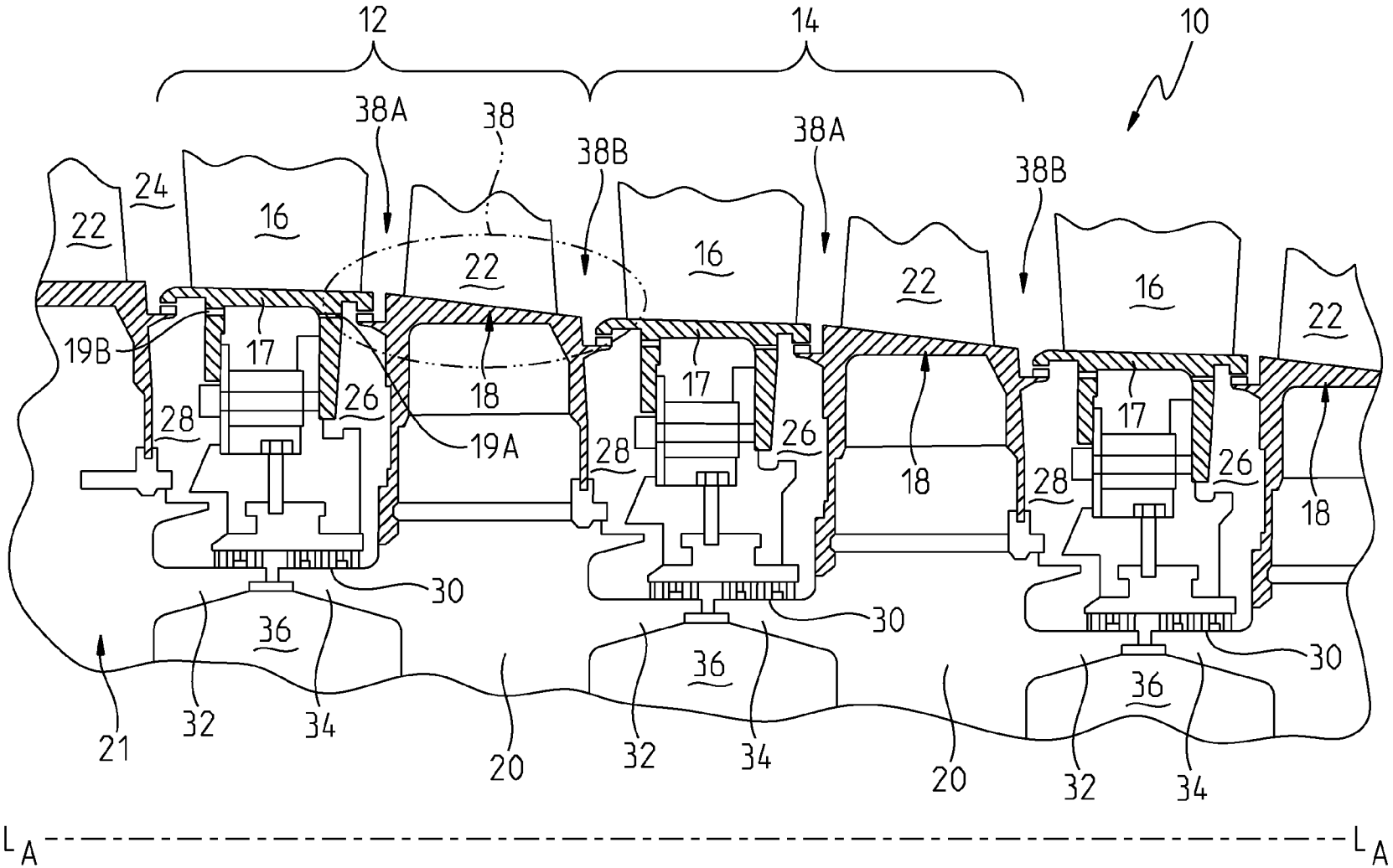
FIG. 1 is a diagrammatic sectional view of a portion of a gas turbine engine including a plurality of seal assemblies in accordance with an embodiment of the invention.

Referring to FIG. 1, a portion of a turbine engine 10 is illustrated diagrammatically including adjoining stages 12, 14, each stage comprising an array of stationary components, illustrated herein as vanes 16 suspended from an outer casing (not shown) and affixed to an annular inner shroud 17, and an array of rotating blade structures 18 supported on a disc structure 20 for rotation on a turbine rotor 21. The vanes 16 and the blade structures 18 are positioned circumferentially within the engine 10 with alternating rows of vanes 16 and blade structures 18 located in an axial direction defining a longitudinal axis $L_A$ of the engine 10. The vanes 16 and airfoils 22 of the blade structures 18 extend into an annular hot gas path 24. A working gas comprising hot combustion gases is directed through the hot gas path 24 and flows past the vanes 16 and the airfoils 22 to remaining stages during operation of the engine 10. Passage of the working gas through the hot gas path 24 causes rotation of the blade structures 18 and corresponding disc structures 20 to provide rotation of the turbine rotor 21. As used herein, the term "blade structure" may refer to any structure associated with the corresponding disc structure 20 that rotates with the disc structure 20 and the turbine rotor 21, e.g., airfoils 22, roots, side plates, platforms, shanks, etc.

First disc cavities 26 and second disc cavities 28 are illustrated in FIG. 1 and are located radially inwardly from the hot gas path 24. Purge air is provided from a cooling fluid, e.g., air, passing through internal passages (not shown) in the vanes 16 and annular inner shrouds 17, and then through respective shroud passages 19A, 19B, to the disc cavities 26, 28 to cool the blade structures 18 and the annular inner shrouds 17. The purge air also provides a pressure balance against the pressure of the working gas flowing in the hot gas path 24 to counteract a flow of the working gas into the disc cavities 26, 28. In addition, interstage seals comprising labyrinth seals 30 may be supported at the radially inner side of the annular inner shrouds 17 and may be engaged with surfaces defined on paired annular platform arms 32, 34 extending axially from opposed portions of adjoining disc structures 20. An annular cooling cavity 36 is formed between the opposed portions of adjoining disc structures 20 on an inner side of the paired annular platform arms 32, 34. The annular cooling cavities 36 receive cooling air passing through cooling air passages (not shown) to cool the disc structures 20.

Structure on the blade structures 18 and the annular inner shrouds 17 radially inwardly from the airfoils 22 and vanes 16 cooperate to form a plurality of annular seal assemblies 38. Generally, the annular seal assemblies 38 each comprise first and second seal apparatuses 38A, 38B. Each first seal apparatus 38A creates a seal to substantially prevent leakage of the working gas from the hot gas path 24 into a respective first disc cavity 26. Each second seal apparatus 38B creates a seal to substantially prevent leakage of the working gas from the hot gas path 24 into a respective second disc cavity 28.

For exemplary purposes, only one first seal apparatus 38A formed between the hot gas path 24 and the first disc cavity 26, i.e., the first seal apparatus 38A included in the stage 12 of the engine, and only one second seal apparatus 38B formed between the hot gas path 24 and the second disc cavity 28, i.e., the second seal apparatus 38B located at an interface between the stages 12 and 14 of the engine, will be described. However, it is understood that the other first and second seal apparatuses 38A, 38B formed between the hot gas path 24 and other disc cavities 26, 28 within the engine 10 are substantially similar to the first and second seal apparatuses 38A and 38B described herein.

Figure 2:
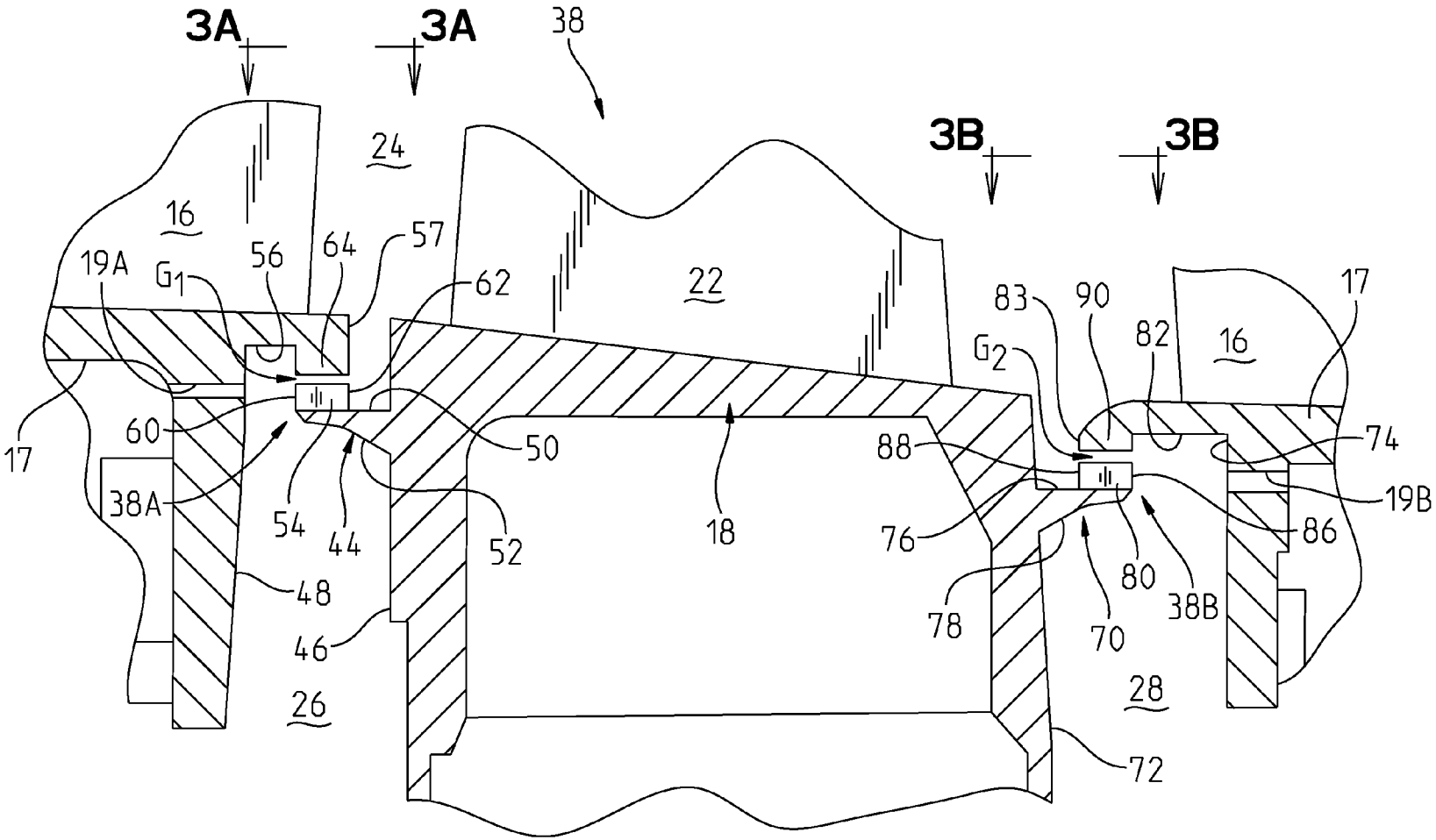
FIG. 2 is an enlarged sectional view of a first seal apparatus and a second seal apparatus of one of the seal assemblies illustrated in FIG. 1.

Referring to FIG. 2, the first seal apparatus 38A is shown. The first seal apparatus 38A is associated with a first axially facing side 46 of an exemplary first described blade structure 18, illustrated as an upstream side of the first described blade structure 18. The first described blade structure 18 includes an exemplary first described row of the airfoils 22. The first axially facing side 46 of the first described blade structure 18 is associated with a respective one of the first disc cavities 26.

A first wing member 44 extends axially from the first axially facing side 46 of the first described blade structure 18 toward a radial surface 48 of an adjacent first annular inner shroud 17 associated with adjacent first vanes 16, the adjacent first annular inner shroud 17 being axially upstream from the first described blade structure 18. The first wing member 44 is formed from a high temperature alloy, such as, for example, an INCONEL alloy (INCONEL is a registered trademark of Special Metals Corporation), although the first wing member 44 may be formed from any suitable material. In the embodiment shown, the first wing member 44 is integral with the first described blade structure 18, although it is understood that the first wing member 44 may be separately formed from the first described blade structure 18 and attached thereto. The first wing member 44 may be generally arcuate shaped in a circumferential direction to substantially correspond to the arcuate shape of the first described blade structure 18 when viewed axially.

The first wing member 44 includes a radially outer side 50 facing radially outwardly from the first wing member 44 and a radially inner side 52 facing radially inwardly from the first wing member 44.

Figure 3B:
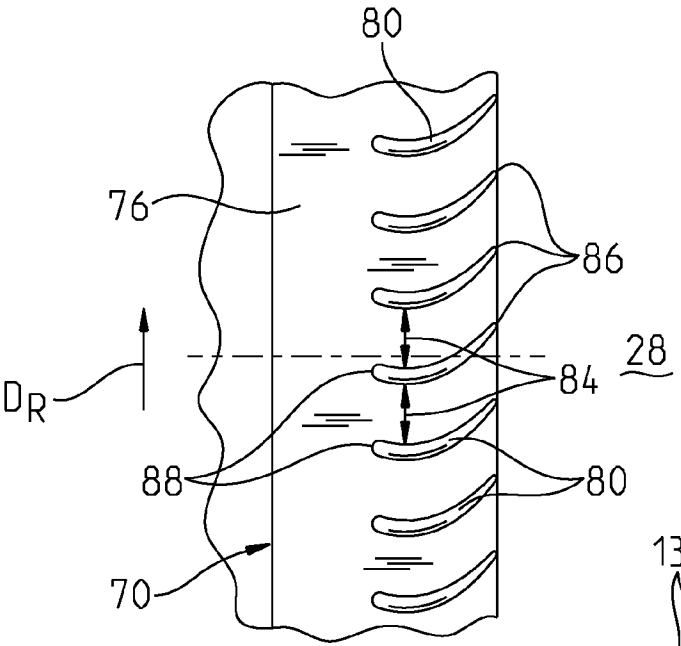
FIG. 3B is a fragmentary elevational view perpendicular to the longitudinal axis of the gas turbine engine illustrating a portion of the second seal apparatus illustrated in FIG. 2.
Figure 3A:
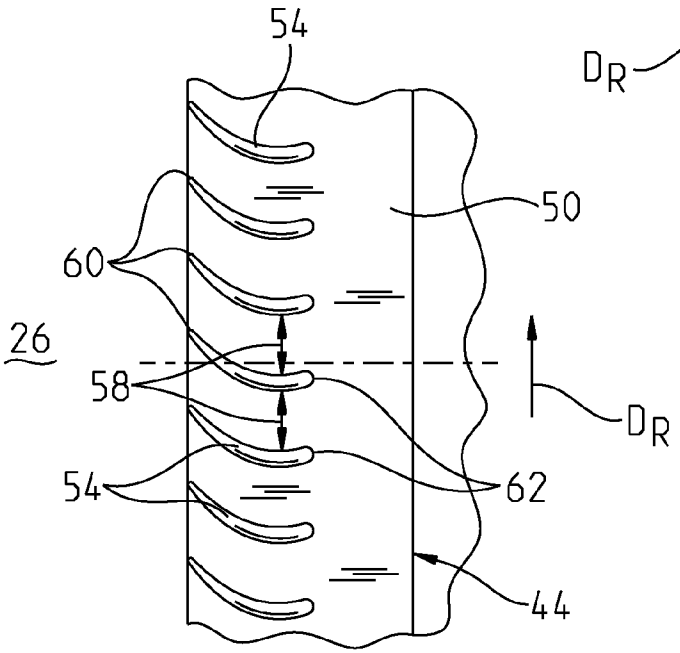
FIG. 3A is a fragmentary elevational view perpendicular to a longitudinal axis of the gas turbine engine illustrating a portion of the first seal apparatus illustrated in FIG. 2.

Referring additionally to FIG. 3A, a plurality of first wing blade members 54 rotatable with the first described row of the airfoils 22 extend from the radially outer side 50 of the first wing member 44. The first wing blade members 54 may be formed from a high temperature alloy, such as, for example, an INCONEL alloy, although the first wing blade members 54 may be formed from any suitable material. The first wing blade members 54 may be integral with the first wing member 44 or may be separately formed and affixed to the first wing member 44 using any suitable affixation procedure, such as, for example, using a welding procedure, or the first wing blade members 54 may be slid, individually or as an assembly comprising more than one of the first wing blade members 54, into a corresponding slot (not shown) formed in the first wing member 44. In the illustrated embodiment, a radial height of the first wing blade members 54, i.e., a radial length from the radially outer side 50 of the first wing member 44, is about 6 mm, although the first wing blade members 54 may have any suitable height.

As shown in FIG. 2, the first wing blade members 54 extend toward a radially inwardly facing surface 56 of an axial end portion 57 of the adjacent first annular inner shroud 17. The radially inwardly facing surface 56 of the axial end portion 57 is located adjacent to and extends in a transverse direction from the radial surface 48 of the adjacent first annular inner shroud 17. As shown in FIG. 2, the radially inwardly facing surface 56 of the adjacent first annular inner shroud axial end portion 57 axially overlaps the plurality of first wing blade members 54.

As shown in FIG. 2, a first shroud flange 64 extends radially inwardly from the radially inwardly facing surface 56 of the adjacent first annular inner shroud axial end portion 57 toward the radially outer side 50 of the first wing member 44. The first shroud flange 64 may be arcuate shaped in the circumferential direction to substantially correspond to the arcuate shape of the adjacent first annular inner shroud 17 when viewed axially. In the embodiment shown, at least a portion of the first shroud flange 64 axially overlaps at least a portion of the first wing blade members 54 such that a first radial gap $G_1$ is formed between the first shroud flange 64 and the plurality of first wing blade members 54. The first radial gap $G_1$, which is slightly oversized as shown in FIGS. 1 and 2 for clarity, includes a dimension in a radial direction of, for example, about 2-5 millimeters, although it is noted that the radial dimension of the first radial gap $G_1$ may vary depending on the particular configuration of the engine 10. The first shroud flange 64 effects a reduced radial clearance between the adjacent first annular inner shroud 17 and the first wing blade members 54, i.e., lessens the radial dimension of the first radial gap $G_1$. It is noted that at least a portion, e.g., a radially inner surface, of the first shroud flange 64 may comprise an abradable material, such as, for example, a honeycomb material, so as to prevent or reduce abrasion and wear of the first shroud flange 64 surfaces and the first wing blade members 54 in the event that rubbing contact occurs between the first shroud flange 64 and the first wing blade members 54.

Referring to FIG. 3A, the first wing blade members 54 are disposed in a substantially aligned circumferential row on the radially outer side 50 of the first wing member 44. A first space 58 having a component in the circumferential direction is formed between adjacent first wing blade members 54. The size of the first space 58 may vary depending on the particular configuration of the engine 10. However, in the exemplary embodiment shown, the circumferential component of the first space 58 is about 10 mm.

In the embodiment shown in FIG. 3A, each of the first wing blade members 54 is curved in the axial direction from a leading edge 60 thereof to a trailing edge 62 thereof. However, it is understood that, rather than, or in addition to, being curved in the axial direction, the first wing blade members 54 may be angled in the axial direction, e.g., the first wing blade members 54 may be formed as straight or substantially straight members that are angled in the axial direction. In the embodiment shown in FIG. 3A, a concave side of each of the curved plurality of first wing blade members 54 faces a direction of rotation $D_R$ of the turbine rotor 21.

In the embodiment shown in FIG. 3A, the leading edge 60 of each of the first wing blade members 54 is located circumferentially in front of the trailing edge 62 of the corresponding first wing blade member 54 in the direction of rotation $D_R$ of the turbine rotor 21. Thus, as the first wing blade members 54 rotate along with the turbine rotor 21 during operation of the engine 10, a portion of the working gas that approaches the first wing blade members 54 is forced axially away from the first wing blade members 54 and away from the first disc cavity 26.

The second seal apparatus 38B, shown in FIG. 2, is associated with a second axially facing side 72 of the first described blade structure 18, illustrated as a downstream side of the first described blade structure 18. The second axially facing side 72 is associated with a respective one of the second disc cavities 28. A second wing member 70 of the second seal apparatus 38B extends toward a radial surface 74 of an adjacent second annular inner shroud 17 associated with adjacent second vanes 16, the adjacent second annular inner shroud 17 being axially downstream from the first described blade structure 18. The second wing member 70 is formed from a high temperature alloy, such as, for example, an INCONEL alloy, although the second wing member 70 may be formed from any suitable material. In the embodiment shown, the second wing member 70 is integral with the first described blade structure 18, although it is understood that the second wing member 70 may be separately formed from the first described blade structure 18 and attached thereto. The second wing member 70 may be generally arcuate shaped in the circumferential direction to substantially correspond to the arcuate shape of the first described blade structure 18 when viewed axially.

The second wing member 70 includes a radially outer side 76 facing radially outwardly from the second wing member 70 and a radially inner side 78 facing radially inwardly from the second wing member 70.

Referring additionally to FIG. 3B, a plurality of second wing blade members 80 rotatable with the first described row of the airfoils 22 extend from the radially outer side 76 of the second wing member 70. The second wing blade members 80 may be formed from a high temperature alloy, such as, for example, an INCONEL alloy, although the second wing blade members 80 may be formed from any suitable material. The second wing blade members 80 may be integral with the second wing member 70 or may be separately formed and affixed to the second wing member 70 using any suitable affixation procedure, such as, for example, using a welding procedure, or the second wing blade members 80 may be slid, individually or as an assembly comprising more than one of the second wing blade members 80, into a corresponding slot (not shown) formed in the second wing member 70. In the illustrated embodiment, a radial height of the second wing blade members 80, i.e., a radial length from the radially outer side 76 of the second wing member 70, is about 6 mm, although the second wing blade members 80 may have any suitable height.

As shown in FIG. 2, the second wing blade members 80 extend toward a radially inwardly facing surface 82 of an axial end portion 83 of the adjacent second annular inner shroud 17. The radially inwardly facing surface 82 of the axial end portion 83 is located adjacent to and extends in a transverse direction from the radial surface 74 of the adjacent second annular inner shroud 17. As shown in FIG. 2, the radially inwardly facing surface 82 of the second annular inner shroud axial end portion 83 axially overlaps the plurality of second wing blade members 80.

As shown in FIG. 2, a second shroud flange 90 extends radially inwardly from the radially inwardly facing surface 82 of the adjacent second annular inner shroud axial end portion 83 toward the radially outer side 76 of the second wing member 70. The second shroud flange 90 may be arcuate shaped in the circumferential direction to substantially correspond to the arcuate shape of the adjacent second annular inner shroud 17 when viewed axially. In the embodiment shown, at least a portion of the second shroud flange 90 axially overlaps at least a portion of the second wing blade members 80 such that a second radial gap $G_2$ is formed between the second shroud flange 90 and the plurality of second wing blade members 80. The second radial gap $G_2$, which is slightly oversized as shown in FIGS. 1 and 2 for clarity, includes a dimension in the radial direction of, for example, about 2-5 millimeters, although it is noted that the radial dimension of the second radial gap $G_2$ may vary depending on the particular configuration of the engine 10. The second shroud flange 90 effects a reduced radial clearance between the adjacent second annular inner shroud 17 and the second wing blade members 80. i.e., lessens the radial dimension of the second radial gap $G_2$. It is noted that at least a portion. e.g., a radially inner surface, of the second shroud flange 90 may comprise an abradable material, such as, for example, a honeycomb material, to prevent or reduce abrasion and wear of the second shroud flange 90 surfaces and the second wing blade members 80 in the event that rubbing contact occurs between the second shroud flange 90 and the second wing blade members 80.

Referring to FIG. 3B, the second wing blade members 80 are disposed in a substantially aligned circumferential row on the radially outer surface 76 of the second wing member 70. A second space 84 having a component in the circumferential direction is formed between adjacent second wing blade members 80. The size of the second space 84 may vary depending on the particular configuration of the engine 10. However, in the exemplary embodiment shown, the circumferential component of the second space 84 is about 10 mm.

In the embodiment shown in FIG. 3B, each of the second wing blade members 80 is curved in the axial direction from a leading edge 86 thereof to a trailing edge 88 thereof. However, it is understood that, rather than, or in addition to, being curved in the axial direction, the second wing blade members 80 may be angled in the axial direction e.g., the second wing blade members 80 may be formed as straight or substantially straight members that are angled in the axial direction. In the embodiment shown in FIG. 3B, a concave side of each of the curved plurality of second wing blade members 80 faces the direction of rotation $D_R$ of the turbine rotor 21.

In the embodiment shown in FIG. 3B, the leading edge 86 of each of the second wing blade members 80 is located circumferentially in front of the trailing edge 88 of the corresponding second wing blade member 80 in the direction of rotation $D_R$ of the turbine rotor 21. Thus, as the second wing blade members 80 rotate along with the turbine rotor 21 during operation of the engine 10, a portion of the working gas that approaches the second wing blade members 80 is forced axially away from the second wing blade members 80 and away from the second disc cavity 28.

During operation of the engine 10, purge air is pumped into the first and second disc cavities 26, 28 through respective ones of the shroud passages 19A, 19B, although it is understood that the purge air may be pumped into the first and second disc cavities 26, 28 from other locations. As discussed above, the purge air provides cooling to the blade structures 18 and the annular inner shrouds 17 and provides a pressure balance against the pressure of the working gas flowing in the hot gas path 24 to counteract a flow of the working gas into the disc cavities 26, 28.

Further, rotation of the first and second wing blade members 54, 80 with the blade structures 18 and the turbine rotor 21 exerts a suction force on the purge air in the respective first and second disc cavities 26, 28. The suction force on the purge air causes portions of the purge air in the first and second disc cavities 26, 28 to flow to the first and second wing blade members 54, 80. The first and second wing blade members 54, 80 inject the portions of the purge air into the hot gas path 24. The passage of the portions of the purge air from the first and second disc cavities 26, 28 into the hot gas path 24 further assists in preventing leakage of the working gas in the hot gas path 24 into the first and second disc cavities 26, 28 by pushing the working gas in the hot gas path 24 away from the seal apparatuses 38A, 38B of the respective seal assemblies 38.

Figure 4:
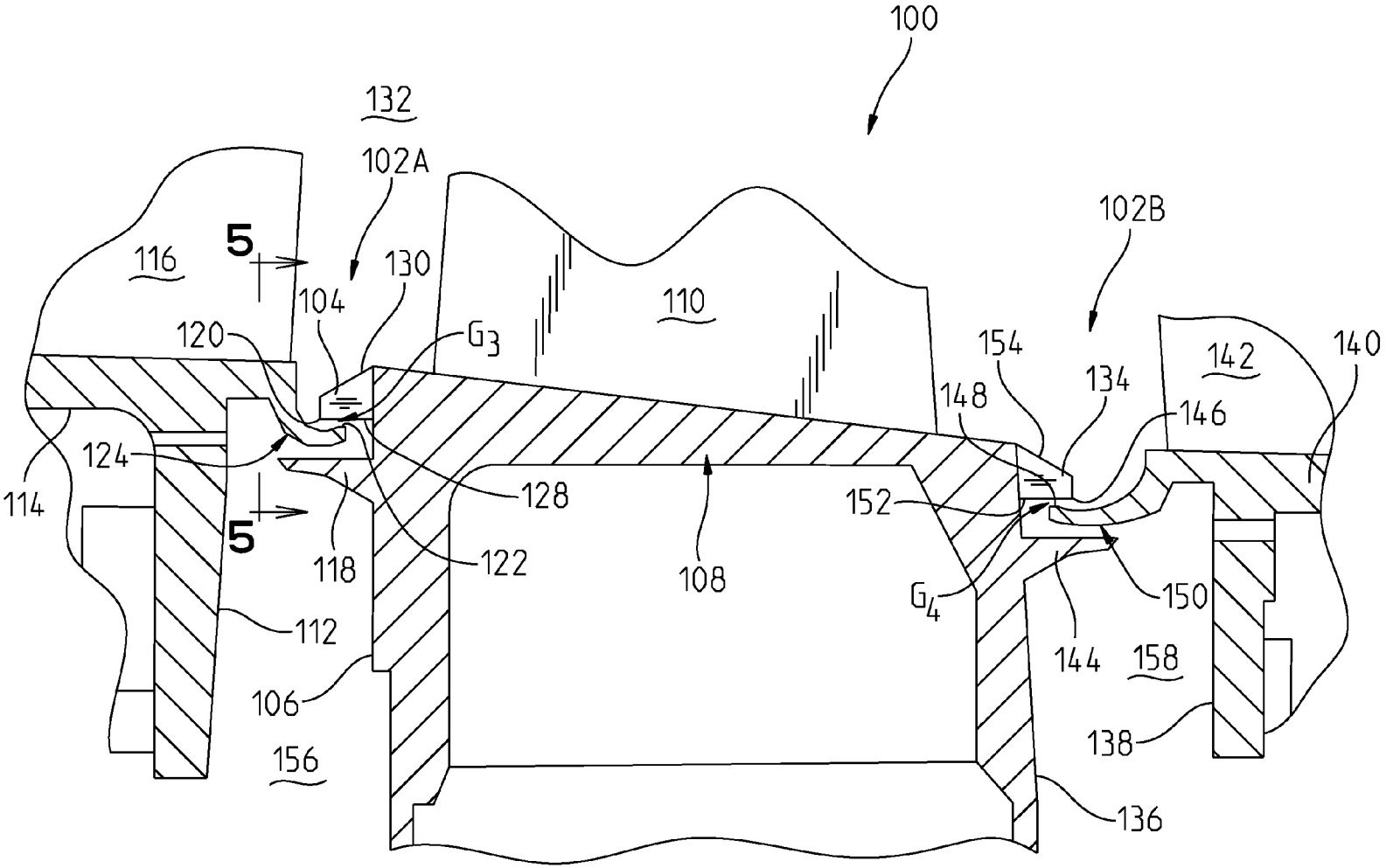
FIG. 4 is an enlarged sectional view of a seal assembly according to another embodiment of the invention.

Referring now to FIG. 4, a seal assembly 100 according to another embodiment is shown. The seal assembly 100 according to this embodiment includes a first seal apparatus 102A and a second seal apparatus 102B. It is noted that a plurality of the seal assemblies 100 according to this embodiment could replace the seal assemblies 38 described above with reference to FIGS. 1, 2, 3A, and 3B. It is also noted that the seal assemblies 38 described above with reference to FIGS. 1, 2, 3A, and 3B could be used in combination with one or more of the seal assemblies 100 according to this embodiment.

The first seal apparatus 102A is associated with a blade structure 108 that includes an exemplary first described row of airfoils 110. The first seal apparatus 102A comprises a plurality of first radial blade members 104 that extend axially from a first axially facing side 106 of the blade structure 108, illustrated as an upstream side of the blade structure 108. The first radial blade members 104 may be formed from a high temperature alloy, such as, for example, an INCONEL alloy, although the first radial blade members 104 may be formed from any suitable material. The first radial blade members 104 may be integral with the blade structure 108 or may be separately formed and affixed to the blade structure 108 using any suitable affixation procedure, such as, for example, using a welding procedure, or the first radial blade members 104 may be slid, individually or as an assembly comprising more than one of the first radial blade members 104, into a corresponding slot (not shown) formed in the blade structure 108. An axial height of the first radial blade members 104, i.e., an axial length from the first axially facing side 106 of the blade structure 108, in the illustrated embodiment is about 16 mm, although the first radial blade members 104 may have any suitable height.

Figure 5:
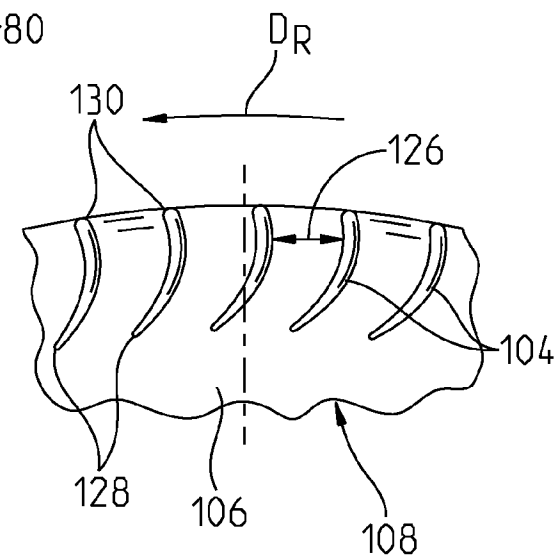
FIG. 5 is a fragmentary axial view along a longitudinal axis of a gas turbine engine illustrating a portion of the first seal apparatus illustrated in FIG. 4.

Referring additionally to FIG. 5, the first radial blade members 104 extend from the first axially facing side 106 of the blade structure 108 toward a radial surface 112 of an adjacent first annular inner shroud 114 associated with adjacent first vanes 116, the adjacent first annular inner shroud 114 being axially upstream from the blade structure 108. The first radial blade members 104 extend from the first axially facing side 106 of the blade structure 108 at a location radially outwardly from a location of a first wing member 118, which first wing member 118 also extends axially from the first axially facing side 106 of the blade structure 108 toward the radial surface 112 of the adjacent first annular inner shroud 114.

As shown in FIG. 4, a radially inner corner portion 120 of each of the first radial blade members 104 is located proximate to a radially outwardly facing surface 122 of an axial end portion 124 of the adjacent first annular inner shroud 114. A third radial gap $G_3$ is formed between the radially outwardly facing surface 122 of the first annular inner shroud axial end portion 124 and the radially inner corner portions 120 of the first radial blade members 104. The third radial gap $G_3$ is preferably large enough such that contact between the first annular inner shroud 114 and the first radial blade members 104 is substantially avoided, even in the case of movement of, i.e., a thermal expansion of, the respective components, such as may occur during operation of a gas turbine engine in which the seal assembly 100 is employed.

It is noted that at least a portion, e.g., the radially outwardly facing surface 122, of the first annular inner shroud 114 may comprise an abradable material, such as, for example, a honeycomb material, to prevent or reduce abrasion and wear of the first annular inner shroud 114 surfaces and the first radial blade members 104 in the event that rubbing contact occurs between the first annular inner shroud 114 and the first radial blade members 104.

Referring now to FIG. 5, the first radial blade members 104 are disposed in a substantially aligned circumferential row on the first axially facing side 106 of the blade structure 108. A third space 126 having a component in a circumferential direction is formed between adjacent first radial blade members 104. The size of the third space 126 may vary depending on the particular configuration of the engine. However, in the exemplary embodiment shown, the circumferential component of the third space 126 is about 10 mm.

In the embodiment shown in FIG. 5, each of the first radial blade members 104 is curved in a radial direction from a leading edge 128 thereof to a trailing edge 130 thereof. However, it is understood that only a portion or portions of the first radial blade members 104 may be curved if desired, e.g., only a portion proximate to the leading and/or trailing edges 128, 130 thereof. Further, it is understood that, rather than, or in addition to, being curved in the radial direction, the first radial blade members 104 may be angled in the radial direction e.g., the first radial blade members 104 may be formed as straight or substantially straight members that are angled in the radial direction. In the embodiment shown in FIG. 5, a concave side of each of the curved plurality of first radial blade members 104 faces a direction of rotation $D_R$ of a turbine rotor (not shown in this embodiment) with which the blade structure 108 and the first radial blade members 104 rotate.

In the embodiment shown in FIG. 5, the leading edge 128 of each of the first radial blade members 104 is located circumferentially in front of the trailing edge 130 of the corresponding first radial blade member 104 in the direction of rotation $D_R$ of the turbine rotor. Thus, as the first radial blade members 104 rotate along with the turbine rotor during operation of the engine, a portion of a working gas that approaches the first radial blade members 104 is forced radially outwardly from the first radial blade members 104 and back toward a hot gas path 132 (see FIG. 4).

As shown in FIG. 4, the second seal apparatus 102B comprises a plurality of second radial blade members 134 that extend axially from a second axially facing side 136 of the blade structure 108, illustrated as a downstream side of the blade structure 108. The second radial blade members 134 may be formed from a high temperature alloy, such as, for example, an INCONEL alloy, although the second radial blade members 134 may be formed from any suitable material. The second radial blade members 134 may be integral with the blade structure 108 or may be separately formed and affixed to the blade structure 108 using any suitable affixation procedure, such as, for example, using a welding procedure, or the second radial blade members 134 may be slid, individually or as an assembly comprising more than one of the second radial blade members 134, into a corresponding slot (not shown) formed in the blade structure 108. An axial height of the second radial blade members 134, i.e., an axial length from the second axially facing side 136 of the blade structure 108, in the illustrated embodiment is about 16 mm, although the second radial blade members 134 may have any suitable height.

The second radial blade members 134 extend toward a radial surface 138 of an adjacent second annular inner shroud 140 associated with adjacent second vanes 142, the adjacent second annular inner shroud 140 being axially downstream from the blade structure 108. The second radial blade members 134 extend from the second axially facing side 136 of the blade structure 108 at a location radially outwardly from a location of a second wing member 144, which second wing member 144 also extends axially from the second axially facing side 136 of the blade structure 108 toward the radial surface 138 of the adjacent second annular inner shroud 140.

As shown in FIG. 4, a radially inner corner portion 146 of each of the second radial blade members 134 is located proximate to a radially outwardly facing surface 148 of an axial end portion 150 of the adjacent second annular inner shroud 140. A fourth radial gap $G_4$ is formed between the radially outwardly facing surface 148 of the second annular inner shroud axial end portion 150 and the radially inner corner portions 146 of the second radial blade members 134. The fourth radial gap $G_4$ is preferably large enough such that contact between the second annular inner shroud 140 and the second radial blade members 134 is substantially avoided, even in the case of movement of, i.e., a thermal expansion of, the respective components, such as may occur during operation of the gas turbine engine in which the seal assembly 100 is employed.

It is noted that at least a portion, e.g., the radially outwardly facing surface 148, of the second annular inner shroud 140 may comprise an abradable material, such as, for example, a honeycomb material, to prevent or reduce abrasion and wear of the second annular inner shroud 140 surfaces and the second radial blade members 134 in the event that rubbing contact occurs between the second annular inner shroud 140 and the second radial blade members 134.

The second radial blade members 134 are arranged on the blade structure 108 in substantially the same configuration as the first radial blade members 104. Specifically, the second radial blade members 134 are disposed in a substantially aligned circumferential row on the second axially facing side 136 of the blade structure 108. A fourth space (not shown) having a component in the circumferential direction, such as, for example, 10 mm, is formed between adjacent second radial blade members 134. The size of the fourth space may vary depending on the particular configuration of the engine.

Further, each of the second radial blade members 134 is curved in the radial direction from a leading edge 152 thereof to a trailing edge 154 thereof. However, it is understood that only a portion or portions of the second radial blade members 134 may be curved if desired. Further, rather than, or in addition to, being curved in the radial direction, the second radial blade members 134 may be angled in the radial direction. A concave side of each of the curved plurality of second radial blade members 134 faces the direction of rotation $D_R$ of the turbine rotor, with which the second radial blade members 134 rotate.

The leading edge 152 of each of the second radial blade members 134 is located circumferentially in front of the trailing edge 154 of the corresponding second radial blade member 134 in the direction of rotation $D_R$ of the turbine rotor. Thus, as the second radial blade members 134 rotate along with the turbine rotor during operation of the engine, a portion of the working gas that approaches the second radial blade members 134 is forced radially outwardly from the second radial blade members 134 and back toward the hot gas path 132.

As with the embodiment described above with reference to FIGS. 1, 2, 3A, and 3B, the first and second seal apparatuses 102A, 102B create a seal to substantially limit leakage of the working gas from the hot gas path 132 into respective first and second disc cavities 156, 158. In this embodiment, the first and second disc cavities 156, 158 are associated with respective ones of the axially first and second sides 106, 136 of the blade structure 108 and also with respective first and second seal apparatuses 102A, 102B. Rotation of the first and second radial blade members 104, 134 with the blade structure 108 and the turbine rotor exerts a suction force on purge air in the respective first and second disc cavities 156, 158. The suction force on the purge air causes portions of the purge air in the first and second disc cavities 156, 158 to flow to the first and second radial blade members 104, 134. The first and second radial blade members 104, 134 inject the portions of the purge air into the hot gas path 132. The passage of the portions of the purge air from the first and second disc cavities 156, 158 into the hot gas path 132 assists in preventing leakage of the working gas in the hot gas path 132 into the first and second disc cavities 156, 158 by pushing the working gas in the hot gas path 132 away from the seal apparatuses 102A, 102B.

It is noted that the first and second wing members 118, 144 may be eliminated from this embodiment, and that, if employed as shown in FIG. 5, the first and second wing members 118, 144 prevent a direct path between the hot gas path 132 and the respective disc cavities 156, 158.

Further, as mentioned previously, the blade members included in the two embodiments discussed above, i.e., the first wing blade members 54 and/or the second wing blade members 80 with reference to FIGS. 1, 2, 3A, and 3B, and the first radial blade members 104 and/or the second radial blade members 134 with reference to FIGS. 4 and 5, could both be employed in a turbine engine. In particular, it may be beneficial to combine the first wing blade members 54 and the first radial blade members 104 in a seal apparatus on an upstream side of a blade structure, i.e., the first described blade structure 18 discussed above with reference to FIG. 1, as there is typically a greater tendency for working gas in a hot gas path to flow into a disc cavity on the upstream side of the blade structure as opposed to a disc cavity on a downstream side of the blade structure.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly that limits gas leakage from a hot gas path to one or more disc cavities in a turbine engine comprising a plurality of stages, each stage comprising a plurality of stationary components and a disc structure supporting a plurality of blade structures for rotation on a turbine rotor, the seal assembly comprising:

a first seal apparatus that limits gas leakage from the hot gas path to a first disc cavity associated with a first axially facing side of a blade structure including a row of airfoils, said first seal apparatus comprising:

a plurality of first blade members rotatable with said blade structure, said first blade members associated with said first axially facing side of said blade structure and extending toward adjacent first stationary components, each said first blade member including a leading edge and a trailing edge, said leading edge of each said first blade member located circumferentially in front of said trailing edge of said corresponding first blade member in a direction of rotation of the turbine rotor, said first blade members arranged such that a space having a component in a circumferential direction is defined between adjacent circumferentially spaced first blade members; and a second seal apparatus that limits gas leakage from the hot gas path to a second disc cavity associated with a second axially facing side of said blade structure, said second seal apparatus comprising:

a plurality of second blade members rotatable with said blade structure, said second blade members associated with said second axially facing side of said blade structure and extending toward adjacent second stationary components, each said second blade member including a leading edge and a trailing edge, said leading edge of each said second blade member located circumferentially in front of said trailing edge of said corresponding second blade member in a direction of rotation of the turbine rotor, said second blade members arranged such that a space having a component in the circumferential direction is defined between adjacent circumferentially spaced second blade members.

2. The seal assembly according to claim 1, wherein each said first blade member and each said second blade member is curved such that a concave side of each said curved first blade member and each curved second blade member faces said direction of rotation of the turbine rotor.

3. The seal assembly according to claim 1, wherein said first and second blade members are substantially arranged in respective circumferential rows.

4. The seal assembly according to claim 1, wherein a rotation of said first blade members effects a passage of disc cavity purge air from said first disc cavity to the hot gas path to assist in limiting gas leakage from the hot gas path to said first disc cavity by forcing gas in the hot gas path away from said first seal apparatus and wherein a rotation of said second blade members effects a passage of disc cavity purge air from said second disc cavity to the hot gas path to assist in limiting gas leakage from the hot gas path to said second disc cavity by forcing gas in the hot gas path away from said second seal apparatus.

5. The seal assembly according to claim 1, wherein said first seal apparatus further comprises a first wing member extending axially from said first axially facing side of said blade structure toward an adjacent first annular inner shroud associated with said adjacent first stationary components, said first wing member including a radially inner side and a radially outer side, and wherein said first blade members comprise first wing blade members arranged on said radially outer side of said first wing member.

6. The seal assembly according to claim 5, wherein each said first wing blade member extends radially outwardly from said outer side of said first wing member toward a radially facing surface of said first annular inner shroud, said radially facing surface of said first annular inner shroud at least partially axially overlapping said first wing blade members.

7. The seal assembly according to claim 6, wherein said second seal apparatus further comprises a second wing member extending axially from said second axially facing side of said blade structure toward an adjacent second annular inner shroud associated with said adjacent second stationary components, said second wing member including a radially inner side and a radially outer side, wherein said second blade members comprise second wing blade members extending radially outwardly from said outer side of said second wing member toward a radially facing surface of said second annular inner shroud, said radially facing surface of said second annular inner shroud at least partially axially overlapping said second wing blade members.

8. The seal assembly according to claim 1, wherein said first blade members comprise first radial blade members extending axially outwardly from said first axially facing side of said blade structure toward an adjacent first annular inner shroud associated with said adjacent first stationary components.

9. The seal assembly according to claim 8, wherein a radially inner corner portion of each said first radial blade member is located proximate to a radially outwardly facing surface of an axial end portion of said first annular inner shroud.

10. The seal assembly according to claim 8, wherein said second blade members comprise second radial blade members extending axially outwardly from said second axially facing side of said blade structure toward an adjacent second annular inner shroud associated with said adjacent second stationary components.

11. A seal assembly that limits gas leakage from a hot gas path to one or more disc cavities in a turbine engine comprising a plurality of stages, each stage comprising a plurality of stationary components and a disc structure supporting a plurality of blade structures for rotation on a turbine rotor, the seal assembly comprising:

a first seal apparatus that limits gas leakage from the hot gas path to a first disc cavity associated with a first axially facing side of a blade structure including a row of airfoils, said first seal apparatus comprising:

a first wing member extending axially from said first axially facing side of said blade structure toward an adjacent first annular inner shroud associated with adjacent first stationary components, said first wing member including a radially inner side and a radially outer side; and a plurality of first wing blade members rotatable with said blade structure and arranged on said radially outer side of said first wing member such that a space having a component in a circumferential direction is defined between adjacent circumferentially spaced first wing blade members, each of said first wing blade members extending radially outwardly from said outer side of said first wing member toward a radially facing surface of said first annular inner shroud, said radially facing surface of said first annular inner shroud at least partially axially overlapping said first wing blade members; and a first shroud flange extending radially inwardly from said radially facing surface of said first annular inner shroud toward said radially outer side of said first wing member, said first shroud flange effecting a reduced radial dimension between said first annular inner shroud and said first wing blade members.

12. The seal assembly according to claim 11, wherein a radially inner surface of said first shroud flange comprises an abradable material.

13. The seal assembly according to claim 11, further comprising:

a second seal apparatus that limits gas leakage from the hot gas path to a second disc cavity associated with a second axially facing side of said blade structure, said second seal apparatus comprising:

a second wing member extending axially from said second axially facing side of said blade structure toward an adjacent second annular inner shroud associated with adjacent second stationary components, said second wing member including a radially inner side and a radially outer side; and a plurality of second wing blade members rotatable with said blade structure, said second wing blade members extending radially outwardly from said outer side of said second wing member toward a radially facing surface of said second annular inner shroud, said second wing blade members arranged such that a space having a component in the circumferential direction is defined between adjacent circumferentially spaced second wing blade members, said radially facing surface of said second annular inner shroud at least partially axially overlapping said second wing blade members.

14. The seal assembly according to claim 11, wherein each said first wing blade member includes a leading edge and a trailing edge, said leading edge of each said first wing blade member located circumferentially in front of said trailing edge of said corresponding first wing blade member in a direction of rotation of the turbine rotor.

15. The seal assembly according to claim 14, wherein each said first wing blade member is curved extending in an axial direction, a concave side of each of said curved first wing blade member facing said direction of rotation of the turbine rotor.

16. A seal assembly that limits gas leakage from a hot gas path to one or more disc cavities in a turbine engine comprising a plurality of stages, each stage comprising a plurality of stationary components and a disc structure supporting a plurality of blade structures for rotation on a turbine rotor, the seal assembly comprising:

a first seal apparatus that limits gas leakage from the hot gas path to a first disc cavity associated with a first axially facing side of a blade structure including a row of airfoils, said first seal apparatus comprising:

a plurality of first radial blade members extending axially outwardly from said first axially facing side of said blade structure toward an adjacent first annular inner shroud associated with adjacent first stationary components, said first radial blade members arranged such that a space having a component in a circumferential direction is defined between adjacent circumferentially spaced first radial blade members, wherein a radially inner corner portion of each said first radial blade member is located proximate to a radially outwardly facing surface of an axial end portion of said first annular inner shroud.

17. The seal assembly according to claim 16, further comprising:

a second seal apparatus that limits gas leakage from the hot gas path to a second disc cavity associated with a second axially facing side of said blade structure, said second seal apparatus comprising:

a plurality of second radial blade members extending axially outwardly from said second axially facing side of said blade structure toward an adjacent second annular inner shroud associated with adjacent second stationary components, said second radial blade members arranged such that a space having a component in the circumferential direction is defined between adjacent circumferentially spaced second radial blade members, wherein a radially inner corner portion of each said second radial blade member is located proximate to a radially outwardly facing surface of an axial end portion of said second annular inner shroud.

18. The seal assembly according to claim 17, wherein:

each said first radial blade member includes a leading edge and a trailing edge, said leading edge of each said first radial blade member located circumferentially in front of said trailing edge of said corresponding first radial blade member in a direction of rotation of the turbine rotor; and each said second radial blade member includes a leading edge and a trailing edge, said leading edge of each said second radial blade member located circumferentially in front of said trailing edge of said corresponding second radial blade member in said direction of rotation of the turbine rotor.

19. The seal assembly according to claim 18, wherein:

each said first radial blade member is curved extending in a radial direction, a concave side of each said curved first radial blade member facing said direction of rotation of the turbine rotor; and each said second radial blade member is curved extending in the radial direction, a concave side of each said curved second radial blade member facing said direction of rotation of the turbine rotor.

* * * * *